US005535809A

United States Patent [19]

White

[11] Patent Number: 5,535,809

[45] Date of Patent: Jul. 16, 1996

[54] METHOD AND APPARATUS FOR PACKING A GRANULAR MATERIAL FOR FOUNDRY USE

[75] Inventor: Lyle E. White, Grand Haven, Mich.

[73] Assignee: Grand Haven Brass Foundry, Grand Haven, Mich.

[21] Appl. No.: 157,981

[22] Filed: Nov. 24, 1993

[51] Int. Cl.[6] ..... B22C 9/10; B22C 13/12; B22C 15/24

[52] U.S. Cl. ..... 164/20; 164/22; 164/159; 164/186; 164/200

[58] Field of Search ..... 164/19, 20, 22, 164/28, 37, 159, 169, 186, 198, 200

[56] References Cited

U.S. PATENT DOCUMENTS

| | | | |
|---|---|---|---|
| 3,278,996 | 10/1966 | Mathys | 164/200 X |
| 3,442,320 | 5/1969 | Hathorn . | |
| 3,584,680 | 6/1971 | Le Blanc et al. . | |
| 3,709,282 | 1/1973 | Taccone . | |
| 3,857,439 | 12/1974 | Bardet . | |
| 4,460,032 | 7/1984 | Lund . | |
| 4,538,664 | 9/1985 | Kobel et al. . | |
| 4,570,694 | 2/1986 | Lund . | |
| 4,617,978 | 10/1986 | Damm . | |
| 4,643,240 | 2/1987 | Lund . | |
| 4,718,474 | 1/1988 | Bellis et al. . | |
| 5,056,582 | 10/1991 | Witte et al. . | |
| 5,078,201 | 1/1992 | Nakamura . | |
| 5,095,967 | 3/1992 | Nagarwalla et al. . | |
| 5,154,229 | 10/1992 | Moonert et al. . | |
| 5,269,363 | 12/1993 | Witte . | |

FOREIGN PATENT DOCUMENTS

| | | | |
|---|---|---|---|
| 1002083 | 8/1983 | U.S.S.R. | 164/37 |
| 1618494 | 1/1991 | U.S.S.R. | 164/37 |

*Primary Examiner*—J. Reed Batten, Jr.
*Attorney, Agent, or Firm*—Price, Heneveld, Cooper, DeWitt & Litton

[57] ABSTRACT

Core sand material is received in an enclosed chamber and is forced into the cavity of a mold by compressing the air above the sand material with essentially no mixing of the air and sand material. The air is compressed by a piston which forces a pressure packer plate downwardly above the core sand material which is held in the bottom of the chamber by a specially designed baffle control plate assembly ready to be forced by the compressed air into the mold.

48 Claims, 8 Drawing Sheets

METHOD AND APPARATUS FOR PACKING A GRANULAR MATERIAL FOR FOUNDRY USE

This invention relates to a method and apparatus for packing granular material such as sand for use in casting and molding metal such as brass.

BACKGROUND OF INVENTION

Granular material packing machines are employed to produce sand cores from very fine sand impregnated with thermo setting resin. Such apparatus typically injects the sand into a mold formed of two halves which are heated and cause the resin in the sand to be cured, resulting into a completed casting core of a desired shape for use to produce desired internal casting configurations in cast parts.

Generally, the most widely used method of introducing the core sand into the mold is by air jets which blow the sand into the core box. This widely used method causes a number of problems. One such problem is that compressed air mixed with sand erodes the core box. Where there are detailed passages in complicated cores, it eventually destroys the core box as a usable box in that the erosion of such edges causes flashing to be formed on the cores. The flashing normally requires what is referred to as "definning," which is the removal of the flashing by filing with a rasp or file. Obviously, "definning" requires a substantial amount of man hours and increases the cost of core making.

Also, blowing core sand causes the resin to separate from the sand creating free resin that sticks onto the core box. A build-up of resin on the core box results in formation of voids in the cores rendering them defective and unusable because it adversely effects the shape of the core.

The above two problems result in a number of bad cores, which are required to be thrown away. Further, the eroding of the core box and the build-up of resin on the core box requires greater maintenance and eventual replacement of the core boxes.

Another problem encountered with the use of blowing the core sand is that it erodes the seal on the blow plate, which is the plate that engages the core box.

Another problem in the blowing of core sand is the need to exhaust or vent the air from the mold. Failure to vent all the air results in air pockets which create voids in the cores.

Because of the above problems in the use of air jets to blow sand for dispensing sand into the core boxes, there has been a long-felt need for a method and apparatus for making sand cores so as to avoid or at least minimize the above problems.

SUMMARY OF THE INVENTION

In accordance with my invention, I completely eliminate the use of air jets for blowing sand into the mold. Instead, I have conceived and developed a method and apparatus in which measured quantities of core material are dropped into an enclosed airtight chamber located above the mold after which the air in said chamber is compressed above the sand core material by a piston means to force the core material through an opening into the cavity of the mold.

My method and apparatus for compressing the air is by means of a downward stroke of a piston means located in the chamber. This piston means includes a pressure packer means located in the chamber. The pressure packer means is actuated downwardly by an air pressure applied to a piston of an air cylinder to force the packer means downwardly and compress the air above the sand core material. In one aspect of my invention, air pressure is also applied above the pressure packer means to prevent any bypassing of the air under the packer means and/or sand between the inner diameter surfaces of the chamber and the packer means.

In accordance with the preferred method and apparatus of this invention, a unique baffle is provided in the chamber below the packer means at the lower end of the housing forming the chamber and for holding substantially all of the core material in the lower end of the chamber until the air in the chamber is compressed. Such baffle means comprises top surface means inclined downwardly and outwardly toward the inner walls of the chamber and lower surfaces extending downwardly and inwardly with the inwardly inclined surfaces terminating at their lower ends at the opening to the mold. The top surfaces and lower surfaces are vertically spaced from each other along their sides and ends to provide openings whereby the sand core material flowing outwardly over the top surfaces passes through the end and side openings and inwardly over the lower surfaces from whence the material can flow through the blow plate opening.

The above described method and apparatus has the decided advantage of minimizing the destruction of the core sand and the molds. The method and apparatus substantially eliminates flashing on the core, thus substantially eliminating and at least minimizing the amount of "definning." The method and apparatus slowly moves the sand into the mold limiting the need to vent the air. The method and apparatus substantially reduces the maintenance of the equipment and, particularly, the molds and the seals on the blow plates. They make possible the forming of complicated cores that otherwise are almost impossible to produce efficiently with prior art methods and apparatus.

DETAILED DESCRIPTION OF THE PREFERRED EMBODIMENT

Figure 1:
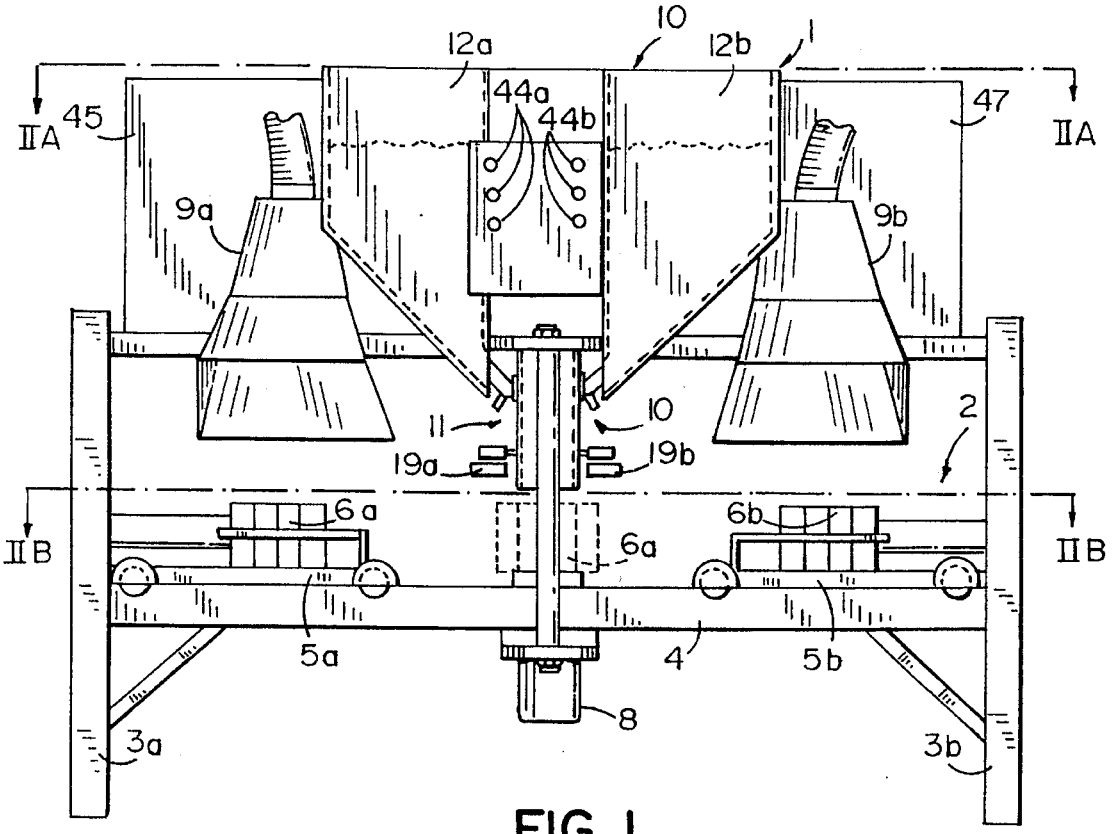
FIG. 1 is a front-elevational view of the apparatus.
Figure 2A:
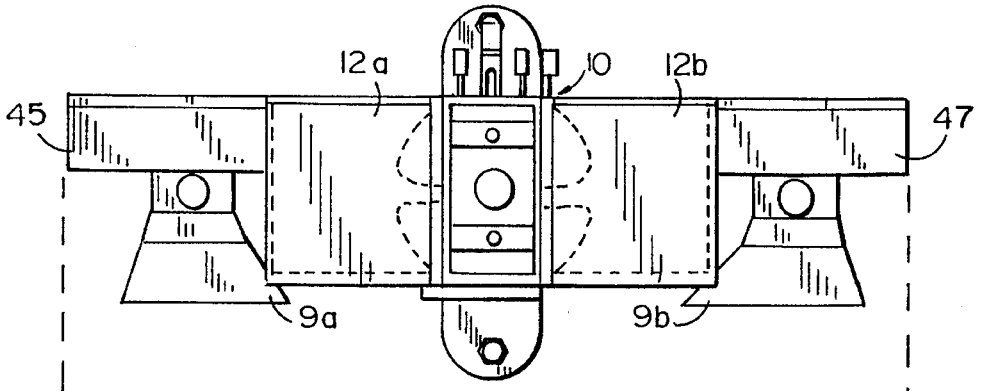
FIG. 2A is a top view taken along the plane IIA—IIA in FIG. 1.
Figure 2B:
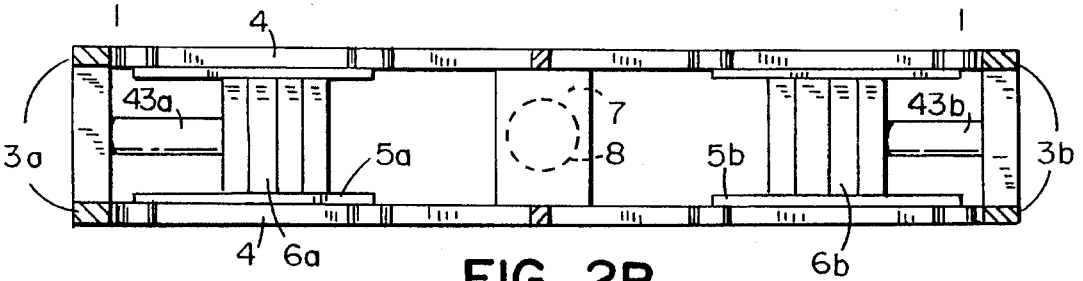
FIG. 2B is a cross-sectional view taken along the plane IIB—IIB in FIG. 1.

Referring to the drawings, reference numeral 1 designates the overall apparatus which includes the frame 2 which includes the uprights 3*a* and 3*b* supporting a track 4 on which is mounted at each end the carriages 5*a* and 5*b* supporting the molds 6*a* and 6*b*, respectively, for movement to the positions as designated by the broken lines under the packing system 10. Under the packing system 10 is a platform 7 adapted to be actuated by the cylinder 8 for lifting either one of the molds 6*a* or 6*b*, when located in the dotted positions, into engagement with the lower end of the housing 11. Exhaust vents 9*a* and 9*b* are provided for exhausting fumes generated by the heating and curing of the sand mold material. Additional exhaust vents (not shown) are generally provided adjacent the lower end of the housing 11.

Figure 3:
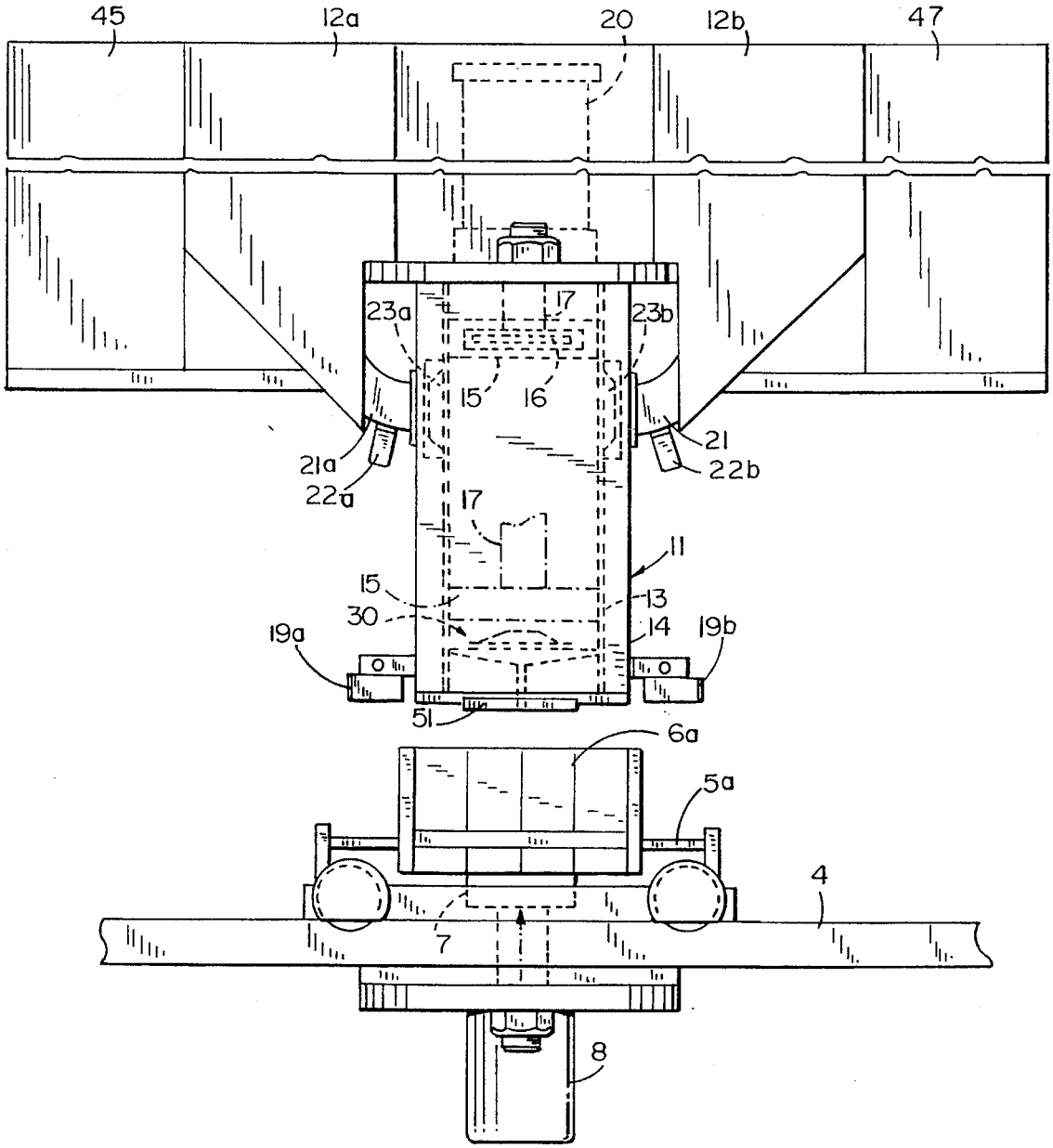
FIG. 3 is an enlarged, front-elevational view of a portion of the apparatus as disclosed in FIG. 1 with a mold moved into a position under the packing system.

FIGS. 1 and 3 also disclose automatic actuated scrapers 19*a* and 19*b* mounted on the sides of housing 11 provided to scrape off excess sand mold material on the top of the molds 6*a* and 6*b* after they have been packed and as they move back to the position as disclosed in FIG. 1.

Figure 4:
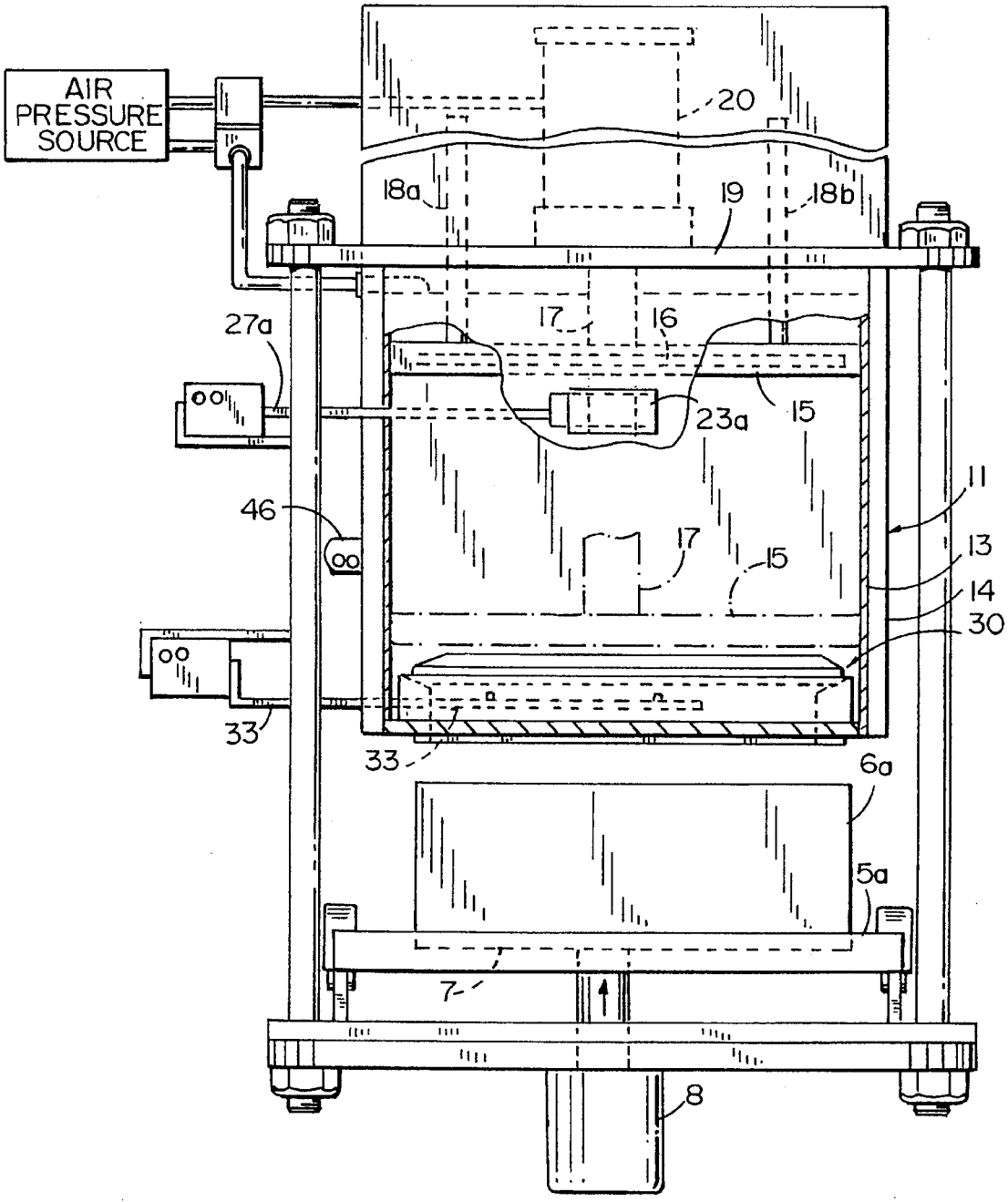
FIG. 4 is an enlarged side-elevational view of a portion of the apparatus of FIG. 1.
Figure 5:
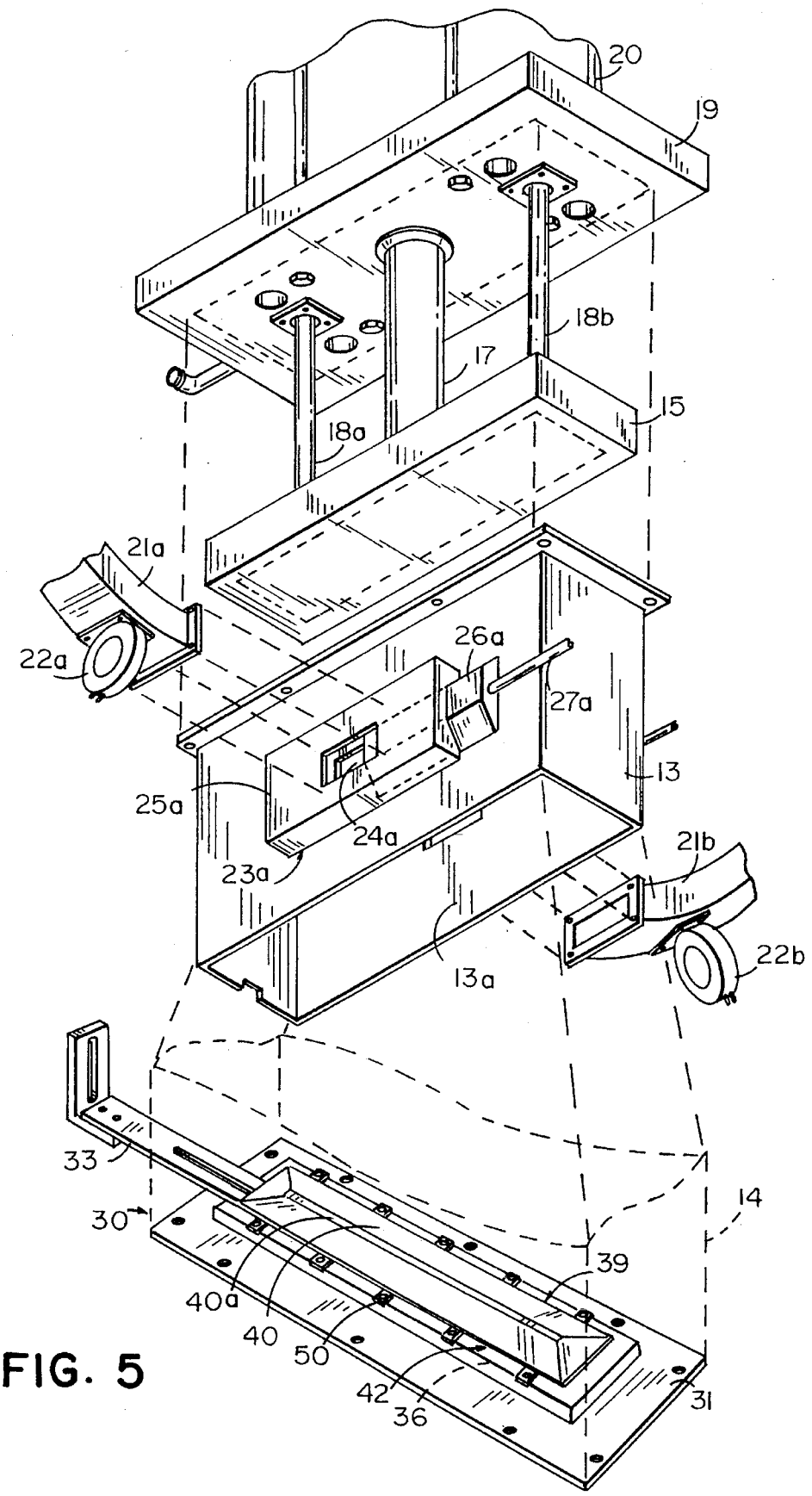
FIG. 5 is an exploded, perspective view of the components of that portion of the apparatus as disclosed in FIGS. 3 and 4.
Figure 9:
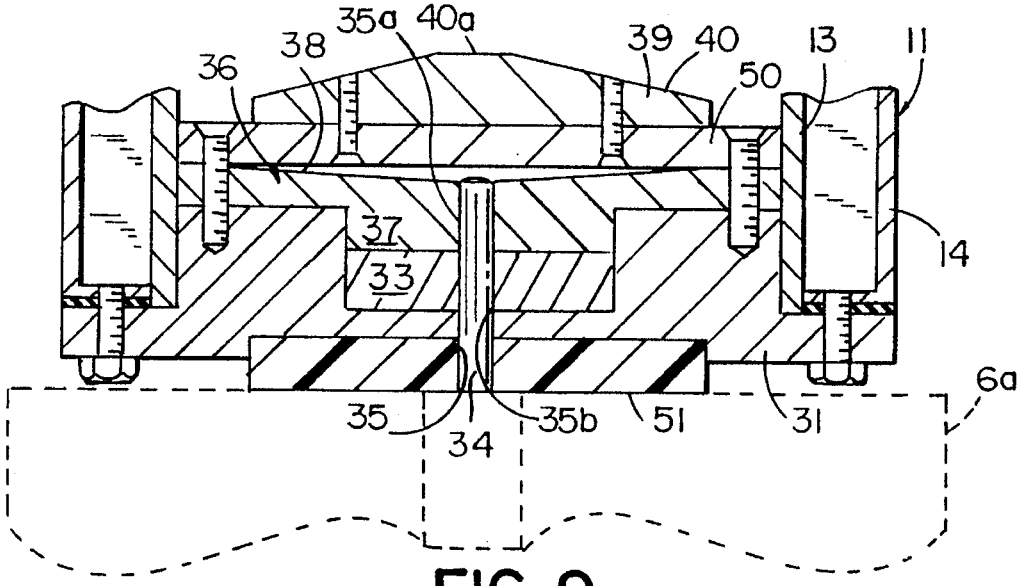
FIG. 9 is a cross-sectional view of the baffle control plate assembly taken along the plane IX—IX of FIG. 7.
Figure 11:
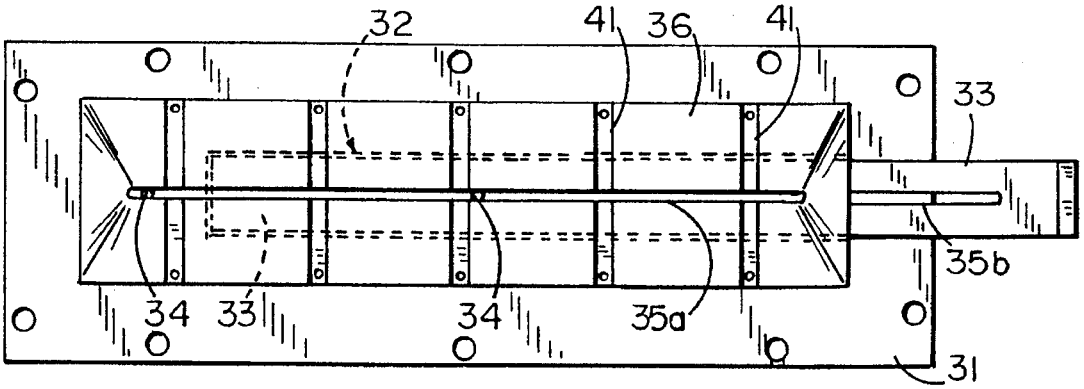
FIG. 11 is a top plan view of one of the components of the baffle control plate with another component located therein.
Figure 12:
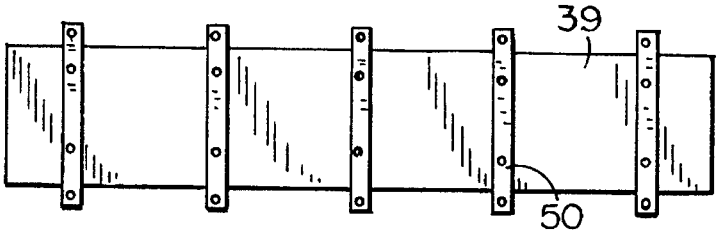
FIG. 12 is a top plan view of another component of the baffle control plate.

FIGS. 4, 5, and 9 disclose in greater detail the strike-off plate 33 having spaced pins 34 (see FIG. 11) for cleaning the slots in the baffle control plate assembly 30 which is described in greater detail hereinafter.

The crux of this invention lies in the packing system 10 which is disclosed in greater detail in FIGS. 3–13. Referring to these figures, reference numerals 12*a* and 12*b* designate hoppers for containing sand core material which is a sand impregnated with a thermal setting resin which when heated and cured, sticks together to form a porous sand core. The housing 11 is mounted between the two hoppers 12*a* and 12*b* and includes the inner housing 13 and outer housing 14 which is provided to insulate the inner housing 13. A pressure packing plate 15 is located for sliding movement within the housing 13. It is constructed of a polyurethane having a steel plate 16 (FIGS. 3 and 4) embedded therein and connected to the piston rod 17 and guide rods 18*a* and 18*b*. As best disclosed in FIG. 5, the piston rod 17 and guide rods 18*a* and 18*b* extend through a header plate 19 which supports the piston cylinder 20 having a piston (not shown) connected to piston rod 17.

Pressure plate 15 is adapted to be actuated from an upper position to a lower position as disclosed in FIGS. 3 and 4. Chutes 21*a* and 21*b* are connected to the lower end of hoppers 12*a* and 12*b*, respectively, and to the upper end of inner housing 13 for dispensing the sand mold material into the inner housing 13. As disclosed in both FIGS. 3 and 4, chutes 21*a* and 21*b* are located below the upper position of the pressure packer plate 15. Vibrators 22*a* and 22*b* are mounted on chutes 21*a* and 21*b*, respectively, for preventing any bridging of the sand mold in the chutes 21*a* and 21*b* and assisting the flow of the sand material into housing 13. A valve or gate is located on each side of the inner housing 13 (FIG. 5). Gate 23*a*, disclosed in FIG. 5, has an opening 24*a* communicating with the chute 21*a*. This opening 24*a* extends through the valve body 25*a* and into the housing 13. A valve member 26*a* slides within the body 25*a* for opening and closing the opening 24*a* to prevent or permit the flow of the sand mold material into the chamber 13*a* of the housing 13. A rod 27*a* is connected to the valve member 26*a* for actuating the valve as will be explained hereinafter. A corresponding gate 23*b* is also located on the side of housing 13 opposite gate 23*a*.

Figure 6:
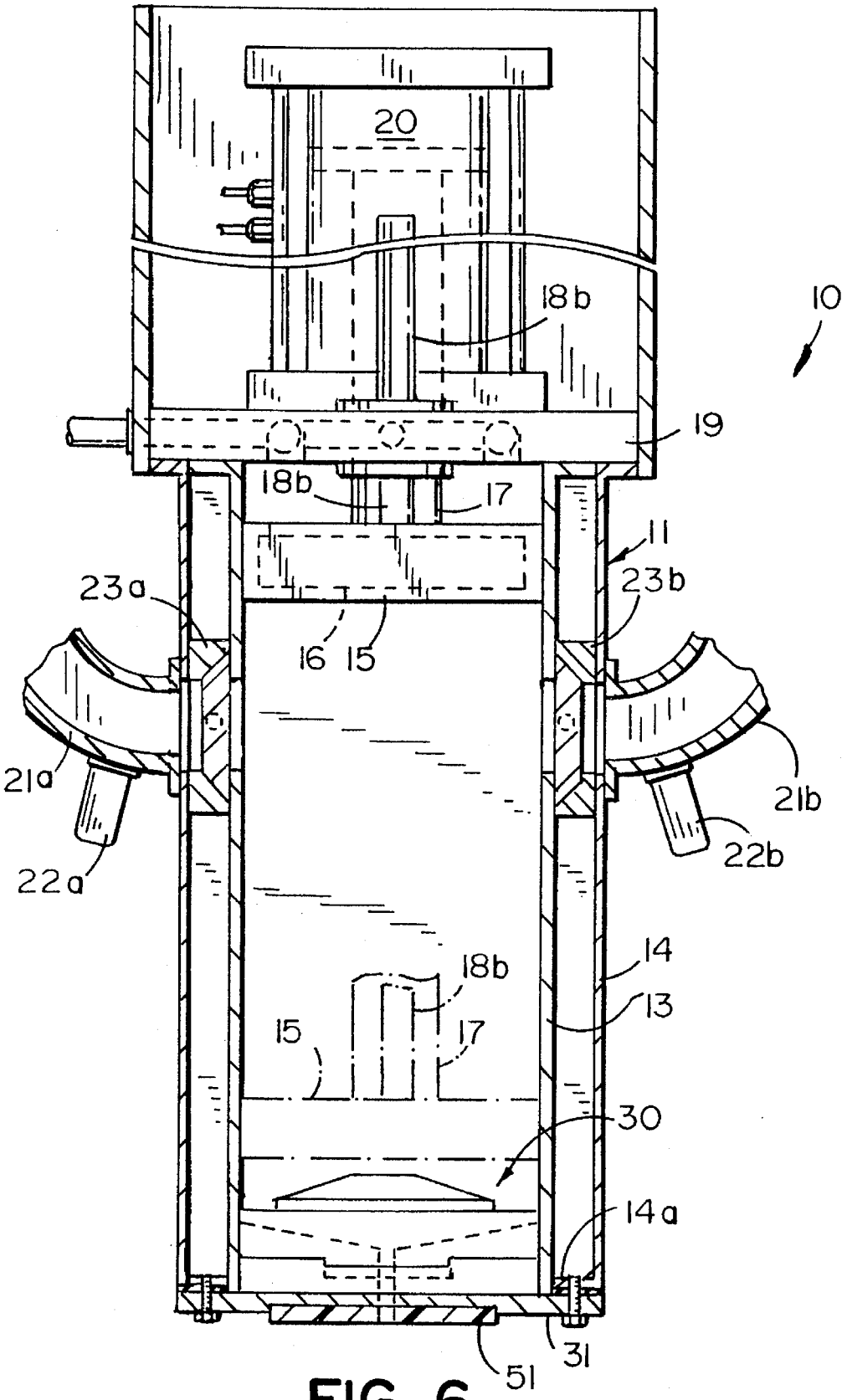
FIG. 6 is a side-elevational, cross-sectional, enlarged view of a portion of the apparatus as disclosed in FIGS. 3 and 4.
Figure 7:
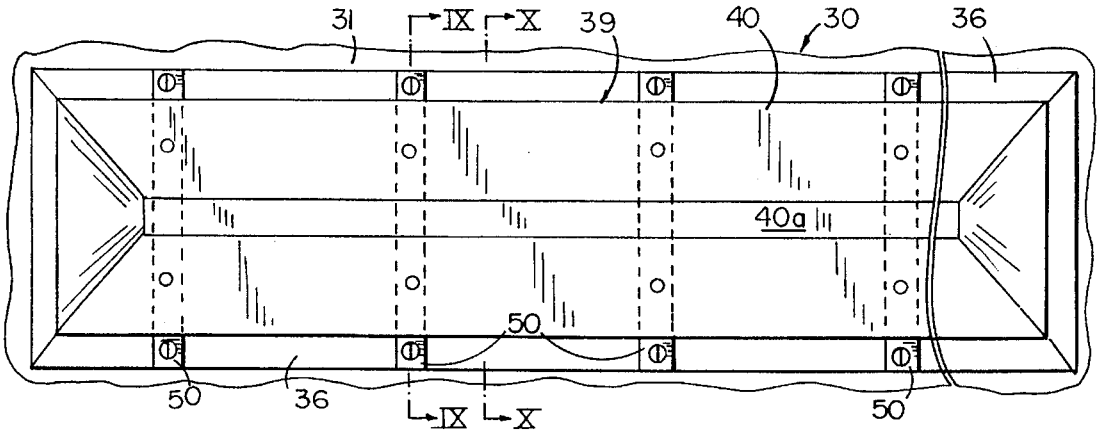
FIG. 7 is an enlarged, top plan view of the baffle control plate assembly of this invention.
Figure 8:
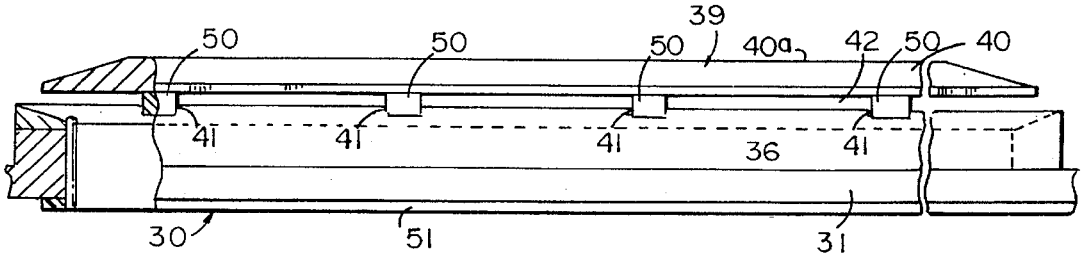
FIG. 8 is an enlarged side-elevational view of the baffle control plate assembly of this invention.

Within one aspect of this invention, I conceived and developed in combination with the structure as described a unique baffle control plate assembly 30 mounted at the extreme lower end of the housing 11 and extending into inner housing 13. Baffle control plate 30 extends into the end of the inner housing 13 and is mounted on the end of the outer housing 14 (FIG. 6).

Baffle control plate assembly 30 is disclosed in greater detail in FIGS. 5–12. It includes a base plate 31 mounted on the flange 14*a* (FIG. 6) of the outer housing 14. Base plate 31 has a recess on its lower surface in which a seal 51 is embedded to engage a core box. The top surface of base plate 31 includes a groove 32 (FIGS. 9 and 10) in which is slidably mounted a strike-off plate 33 which, as disclosed in FIG. 9, has several spaced pins 34 extending into the slot 35*a* of base plate 31 and slots 35*b* and 35*c* of baffle plate 36 and seal 51, respectively, for cleaning out the opening after each operation. A first baffle plate 36 is mounted above the base plate 31 and includes a protrusion 37 extending downwardly into the groove 32 of the base plate above the strike-off plate 33. The top or upper surface of the first baffle plate 36 is tapered downwardly at an angle of 4° to the slot 35*b*.

A second baffle plate 39 is mounted in spaced relationship above the first baffle plate 36 by means of a plurality of spacer bars 50 extending into spaced grooves 41. The bars 50 serve the dual purpose of mounting the second baffle plate on the first baffle plate 39 and also spacing the second baffle plate above the first baffle plate to provide an opening 42 extending around the entire periphery of baffle plate 39 except where the bars 50 are located. The second baffle plate 39 has a top surface 40 inclined downwardly 12° from a flat, narrow, center section 40*a*. The ends of the upper surface 38 of baffle plate 39 also are inclined downwardly at a 14° angle.

Figure 10:
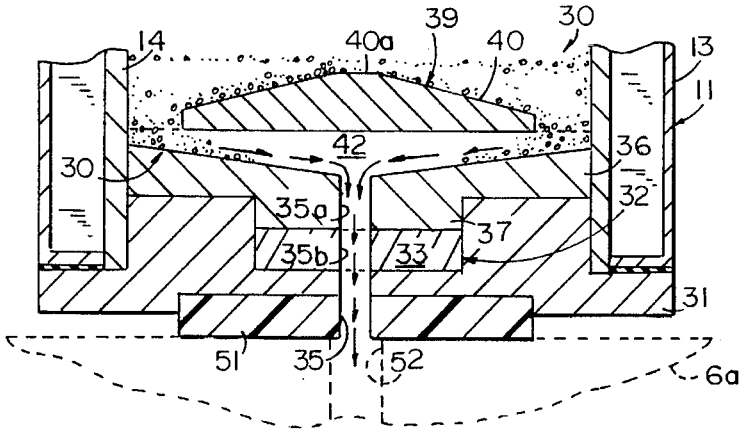
FIG. 10 is a cross-sectional view of the baffle control plate taken along the plane X—X of FIG. 7.

FIGS. 9 and 10 disclose the relationship of all the parts forming the baffle control plate assembly 30. It should be evident frown these drawings that the mold sand dispensed from either of the hoppers 12*a* or 12*b* falls downward by gravity on the top of the baffle control plate assembly. The angle of the top surface 40 causes the mold sand material to slide downwardly toward the sidewalls of housing 13. Since the angle of the inclined top surface 40 is greater than the angle of the top surface 38 of the first baffle plate, the mold sand will be held essentially at the position as disclosed in FIG. 10, that is, it will not flow down the surface 38 until the air above the baffle control plate assembly is compressed forcing the sand mold to follow the path as indicated by the arrows and thus be forced into the slots 35*a*, 35*b*, and 35 of the baffle 37, strike-off plate 33 and base plate 31, respectively, and into the mold 6*a* or 6*b*. In order to keep the core sand evenly distributed above the baffle control plate assembly so that it will flow smoothly, I provide a vibrator 46 (FIG. 4).

Having described the mechanical components of the present invention, the means for controlling the movable components will now be briefly described by reference to FIG. 13 in relation to the other figures.

The apparatus includes the pneumatic controls 45 which, in turn, are controlled by the computer circuitry 47. It should be understood that the control of the apparatus is described in block form which is well within the understanding of a person skilled in the art.

Figure 13:
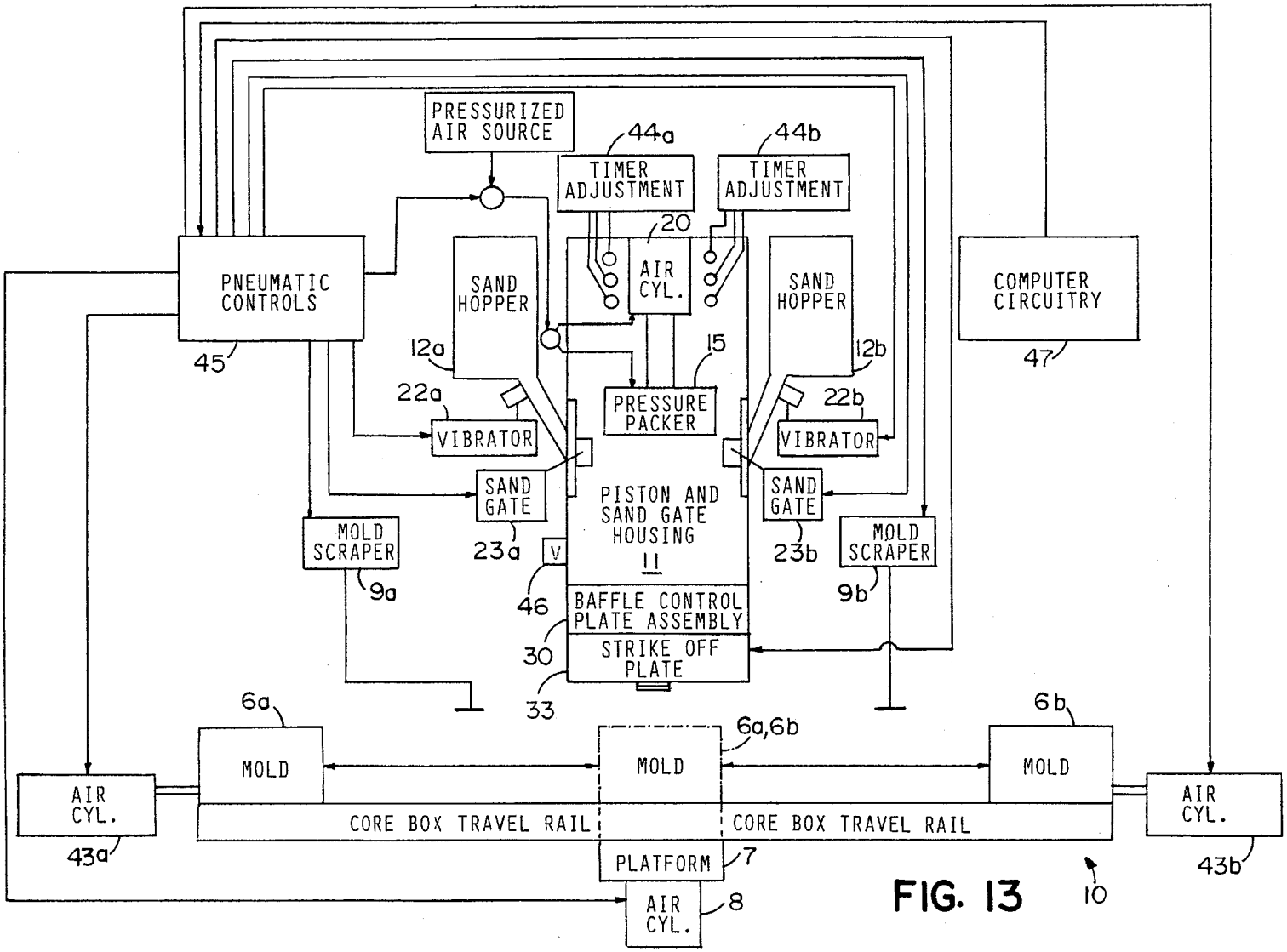
FIG. 13 is a schematic of several components of this invention schematically illustrating the controls thereof.

It will be noted in FIG. 13 that molds 6*a* and 6*b* are actuated into a position under the packing system 10 by means of air cylinders 43*a* and 43*b* , respectively. The molds are actuated and moved to the position as shown in dotted line in a time sequence controlled by the pneumatic controls 45 and the computer circuitry 47. This is also true of the actuation of the platform 7 by the air cylinder 8. The pneumatic controls 45 and computer circuitry also control the proper timed sequence of the opening of the sand gates 23*a* and 23*b* and the operation of the vibrators 22*a*, 22*b*, and 46. The operation of the air cylinder 20 is also controlled in timed sequence by the pneumatic controls 45 and computer circuitry 47. Timer adjustments 44*a* and 44*b* are provided to adjust the timing of the application of pressure to the air cylinder 20 and above pressure packer plate 15, the opening and closing of sand gates 23*a* and 23*b*, and the curing time of the core sand material in the molds. All of the components of the apparatus are thus operated in a proper time sequence as will now be described in the description of the operation.

OPERATION

Since a description of forming a core in each of the molds 6*a* and 6*b* would be duplicative, only one operation will be described in relation to the mold 6*a*, it being understood the arrangement of the two molds is to speed up the operation of core making by permitting the operator to remove a core from one mold while the other is packed with core sand material.

The operation starts by one of the air cylinders 43*a* or 43*b* moving its mold to the position under the packing system 10.

The mold 6*a* is heated and closed providing only an opening 52 in the top for introducing the core sand material (FIGS. 9 and 10). When in this position as disclosed by broken lines, the mold 6*a* is actuated upwardly by actuation of the platform 7 by air cylinder 8 and the mold is ready to receive the core sand. This position is best illustrated in FIG. 10 where the slots 35, 35*a*, and 35*b* are all aligned with the opening 52 of the core box 6*a*. With the mold 6*a* in position with respect to the openings 35, 35*b*, and 35*a* of baffle control plate assembly 30, the gate or valve 23*a* is opened by actuation of the rod 27*a* by an air cylinder (not shown) which moves the valve member 26*a* to open the passageway 24*a* between the chute 21*a* and inner housing 13. At the same time, vibrator 22*a* is operated so that the core sand will flow smoothly into the inner housing 13. The vibrator 46 also is operated causing the core sand material to be evenly distributed as disclosed in FIG. 10. The core sand remains above the slot 35*a* by reason of the angles of the top surfaces of the baffle plates 36 and 39. In timed sequence, pressurized air is supplied to piston cylinder 20 causing the piston rod 17 to force the pressure plate 15 downwardly into the chamber 13*a* of the inner housing 13. At the same time, a lower air pressure psi is supplied to inner housing 13 above the top surface of pressure packer plate 15. By this time, the valve or gate 23*a* is closed and as the pressure plate 15 is moved downwardly, the air within the chamber 13*a* below pressure packer plate 15 is compressed and this compressed air forces the core sand material through the opening 42 provided by the space between the first and second baffle plates 36 and 39, such opening being around the entire periphery of the second baffle plate 39 except for the spacer bars 41. The pressure plate 15 moves downwardly to the position as shown in FIGS. 3 and 4, the lowermost position being immediately above the top surface of the second baffle plate 39.

In addition to the force exerted by the piston rod 17 of the air cylinder 20, and as previously stated, the top of the pressure plate 15 is subjected to a pressure which assists in compressing the air within the chamber 13*a* of the inner housing 13. Further, the air pressure above the pressure plate 15 prohibits any back-up of the air and any small amounts of core sand material through the space between the periphery of the pressure plate and the inner housing. Thus, in effect, the air pressure above the pressure plate serves as a seal as well as an additional force to drive the pressure plate.

Having completed packing the core sand into the mold 6*a*, platform 7 is withdrawn downwardly by the air cylinder 8 and mold 6*a* is moved to its original position at which position the operator of the machine opens the mold to remove the core formed therein. As mold 6*a* is moved back to its original position of FIG. 1, scraper 19*a* scrapes excess mold sand off its top surface. Further, strike-off plate 33 is actuated to clean out slots 35, 35*a*, and 35*b*. In order to give the core sufficient time to cure and for the operator to remove the core, mold 6*b* is then moved into the center position under the packing system 10 and the same packing operation in mold 6*b* is accomplished while the operator opens mold 6*a* to remove the core formed therein.

Having described my invention, it should become evident that it does not have the problems encountered with air jet blow type systems for forming cores. Further, I have discovered that with my method and apparatus, much more complicated cores can be formed without defects as experienced in prior art systems. I have also discovered that the molds require less maintenance and replacement. The cores made in accordance with my invention are more uniform. There is very little flashing and no destruction of sand. The resin build-up in the mold is substantially reduced.

Although I have described a preferred embodiment of my invention, it should be understood that other embodiments and modifications can be made all within the spirit of my invention. Therefore, all changes, modifications, alterations and other uses and applications which become apparent to those skilled in the art considering the specification and accompanying drawings, are deemed to be covered by the following claims.

The embodiments of the invention in which an exclusive property or privilege is claimed are defined as follows:

1. A method of making sand cores used to cast metal articles comprising:

providing a heated mold having a cavity and a first opening leading into said cavity;

providing a chamber having a second opening located above and communicating with said first opening, said chamber having a completely enclosed portion except for said second opening communicating with said first opening;

introducing a sand core material absent any blown air above said second opening in said enclosed portion of said chamber; and compressing the air in said chamber above said enclosed portion of said chamber and above said sand core material without blowing air in said chamber to thereby force said sand core material through said first and second openings into said cavity.

2. The method of claim 1 in which the air is compressed solely by a downward stroke of a piston means in said enclosed portion of said chamber.

3. The method of claim 2 in which the piston means includes a pressure packer plate located in said chamber and the air is compressed by the pressure packer plate.

4. The method of claim 3 in which the pressure packer plate is actuated downwardly by air pressure applied to a cylinder piston to force said pressure packer plate downwardly and compress the air above said sand core material.

5. The method of claim 4 in which air pressure is also applied above said pressure packer plate.

6. The method of claim 3 in which said method includes dispensing sand core material into the chamber below said pressure packer plate and holding substantially all of said dispensed core material in the lower end of said chamber until the air in said chamber is compressed; and compressing the air above said sand core material to force said core material into said cavity of said mold.

7. The method of claim 3 in which said method includes providing a baffle at the lower end of said chamber; dispensing the sand core material into the lower end of said chamber on said baffle whereby said baffle holds substantially all of said dispensed core material in the lower end of said chamber until the air in said chamber is compressed; and compressing the air above said sand core material to force said core material into said cavity of said mold.

8. The method of claim 7 in which the pressure packer plate is actuated downwardly by air pressure applied to a cylinder piston to force said pressure packer plate downwardly and compress the air above said sand core material.

9. The method of claim 8 in which air pressure is also applied above said pressure packer plate.

10. The method of claim 1 in which said method includes dispensing sand core material into the lower end of said enclosed portion of said chamber and holding substantially all of said dispensed sand core material in the lower end of said chamber until the air in said portion of said chamber is compressed; and compressing the air above said sand core material to force said core material into said cavity of said mold.

11. The method of claim 1 in which said method includes providing a baffle at the lower end of said chamber; dispensing the sand core material into the lower end of said chamber on said baffle whereby said baffle holds substantially all of said dispensed core material in the lower end of said chamber until the air in said chamber is compressed; and compressing the air above said sand core material to force said core material into said cavity of said mold.

12. A method of packing granular material into a receptacle to form a predetermined shape for use in foundry operations;

providing a receptacle means having a cavity and a first opening leading into said cavity;

providing a chamber having a second opening located above and communicating with said first opening, said chamber having a completely enclosed portion, except for said second opening communicating with said first opening;

providing a granulated material absent any blown air above said second opening in said enclosed portion of said chamber; and compressing the air in said enclosed portion of said chamber above said granulated material without blowing air in said chamber to thereby force said granulated material through said first and second openings opening into said cavity.

13. The method of claim 12 in which the air is compressed solely by a downward stroke of a piston means located in said closed portion of said chamber.

14. The method of claim 13 in which the piston means includes a pressure packer plate located in said chamber and the air is compressed by the pressure packer plate.

15. The method of claim 14 in which the pressure packer plate is actuated downwardly by air pressure applied to a cylinder piston to force said pressure packer plate downwardly and compress the air above said granular material.

16. The method of claim 15 in which air pressure is also applied above said pressure packer plate.

17. The method of claim 13 in which said method includes providing a baffle means at the lower end of said chamber; dispensing the granulated material into the lower end of said chamber on said baffle means whereby said baffle means holds substantially all of said dispensed granulated material in the lower end of said chamber until the air in said chamber is compressed; and compressing the air above said granulated material to force said granular material into said cavity of said receptacle means.

18. Apparatus for packing sand core material into a mold having a cavity and a first opening leading into said cavity comprising:

a housing enclosing a lower chamber portion, said housing provided for being located above said first opening and having a second opening at the lower end of said housing in communication with said first opening; said lower chamber portion completely enclosed except for said second opening communicating with said first opening; dispensing means for dispensing a sand core material into said housing above said second opening; and air compressing means absent any blown air for compressing the air in said lower chamber portion above said sand core material for forcing a sand core material through said first and second openings into said cavity.

19. The apparatus of claim 18 in which the air compressing means is a piston means associated with said housing for compressing the air in said lower chamber portion above said sand core material to force the sand core material into said cavity.

20. The apparatus of claim 19 in which the piston means includes a pressure packer means located in said lower chamber portion and the air is compressed by the pressure packer means.

21. The apparatus of claim 19 in which the piston means includes a pressure packer means located for sliding movement in the lower chamber portion of said housing and an actuating cylinder piston operatively connected to said pressure packer means for actuating said packer means; and a source of air pressure for actuating said piston.

22. The apparatus of claim 21 in which air pressure is also applied to the top of said pressure packer means.

23. The apparatus of claim 18 in which a movable strike-off plate is provided with finger means extending into said second opening for cleaning out said second opening after a packing operation.

24. The apparatus of claim 18 in which a baffle is located in the lower end of said housing for substantially holding said sand core material in said housing until the compressing means forces the sand core material through said first and second openings into said cavity.

25. The apparatus of claim 24 in which the baffle comprises top surfaces inclined downwardly and outwardly and lower surfaces inclined downwardly and upwardly, said lower surfaces terminating at their lower ends at said second opening; said top surfaces and lower surfaces being vertically spaced from each other along the sides thereof to provide side openings whereby said sand core material dispensed on said top surfaces when forced by compressed air flows over said top inclined surfaces outwardly to said side openings and then through said side openings inwardly over said lower surfaces to said second opening.

26. The apparatus of claim 25 in which the air compressing means is a piston means associated with said housing for compressing the air above said sand core material to force the sand core material into said cavity.

27. The apparatus of claim 26 in which the piston means includes a pressure packer means located for sliding movement in the lower chamber portion of said housing and an actuating cylinder piston operatively connected to said packer means for actuating said packer means; and a source of air pressure for actuating said piston.

28. The apparatus of claim 27 in which air pressure is also applied to the top of said pressure packer means.

29. The apparatus of claim 25 in which a movable strike-off plate is provided with finger means extending into said second opening for cleaning out said second opening after a packing operation.

30. Apparatus for packing sand core material into a mold having a cavity and a first opening leading into said cavity comprising:

a housing enclosing a chamber, said housing provided for being located above said first opening and having a second opening at the lower end of said housing in communication with said first opening; dispenser for dispensing a sand core material into said housing above said second opening;

air compressing means for compressing the air above said sand core material for forcing a sand core material through said first and second openings into said cavity; a baffle located in the lower end of said housing for substantially holding said sand core material in said housing until the compressing means forces the sand core material through said first and second openings into said cavity; and said baffle comprising top surfaces inclined downwardly and outwardly and lower surfaces inclined downwardly and upwardly, said lower surfaces terminating at their lower ends at said second opening; said top surfaces and lower surfaces being vertically spaced from each other along the sides thereof to provide side openings whereby said sand core material dispensed on said top surfaces when forced by compressed air flows over said top inclined surfaces outwardly to said side openings and then through said side openings inwardly over said lower surfaces to said second opening.

31. The apparatus of claim 30 in which the top and lower surfaces are symmetrical about a vertical center line drawn through the aligned first and second openings.

32. The apparatus of claim 30 in which the air compressing means is a piston means associated with said housing for compressing the air above said sand core material to force the sand core material into said cavity.

33. The apparatus of claim 32 in which the piston means includes a pressure packer means located for sliding movement in the chamber of said housing and an actuating cylinder piston operatively connected to said packer means for actuating said packer means; and a source of air pressure for actuating said piston.

34. The apparatus of claim 33 in which air pressure is also applied to the top of said pressure packer means.

35. The apparatus of claim 30 in which a movable strike-off plate is provided with finger means extending into said second opening for cleaning out said second opening after a packing operation.

36. The apparatus of claim 30 in which the inclined angles of said top surfaces are less than the inclined angles of said lower surfaces.

37. Apparatus for packing sand core material into a mold having a cavity and a first opening leading into said cavity comprising:

a housing enclosing a chamber, said housing provided for being located above said first opening and having a second opening at the lower end of said housing in communication with said first opening; dispensing means for dispensing a sand core material into said housing above said second opening;

air compressing means for compressing the air above said sand core material for forcing a sand core material through said first and second openings into said cavity;

a baffle located in the lower end of said housing for substantially holding said sand core material in said housing until the compressing means forces the sand core material through said first and second openings into said cavity; and said baffle comprising a first baffle plate having lower surfaces inclined downwardly and inwardly from each side to said second opening forming a centrally located slot; a second baffle plate spacedly mounted above said first baffle plate to provide said side openings; said second baffle plate having a top surface with portions inclined downwardly from a central section toward said side opening.

38. The apparatus of claim 37 in which the inclined angles of said top surfaces are less than the inclined angles of said lower surfaces.

39. Apparatus for packing granular material into a foundry receptacle having a cavity and a first opening leading into said cavity comprising:

a housing enclosing a lower chamber portion, said housing provided for being located above said first opening and having a second opening at the lower end of said housing in communication with said first opening; said lower chamber portion completely enclosed, except for said second opening communicating with said first opening; a dispenser means for dispensing a granular material into said housing above said second opening;

air compressing means absent any blown air for compressing the air in said lower chamber portion above said granular material for forcing a granular material through said first and second openings into said cavity.

40. The apparatus of claim 39 in which the air compressing means is a piston means associated with said housing for compressing the air above said granular material to force the sand core material into said cavity.

41. The apparatus of claim 40 in which the piston means includes a pressure packer means located in said lower chamber portion and the air is compressed by the pressure packer means.

42. The apparatus of claim 40 in which a baffle is located in the lower end of said housing for substantially holding said granular material in said housing until the compressing means forces the grandular material through said first and second openings into said cavity.

43. The apparatus of claim 42 in which the baffle comprises top surfaces inclined downwardly and outwardly and lower surfaces inclined downwardly and upwardly, said lower surfaces terminating at their lower ends at said second opening; said top surfaces and lower surfaces being vertically spaced from each other along the sides thereof to provide side openings whereby said granular material dispensed on said top surfaces when forced by compressed air flows over said top inclined surfaces outwardly to said side openings and then through said side openings inwardly over said lower surfaces to said second opening.

44. The apparatus of claim 42 in which said baffle comprises a first baffle plate having said lower surfaces inclined downwardly and inwardly from each side to said second opening forming a centrally located slot; a second baffle plate spacedly mounted above said first plate to provide said side openings; said second baffle plate having a top surface with portions inclined downwardly from a central section toward said side opening.

45. The apparatus of claim 44 in which the piston means includes a pressure packer means located for sliding movement in the lower chamber portion of said housing and an actuating cylinder piston operatively connected to said packer means for actuating said packer means; and a source of air pressure for actuating said piston.

46. Apparatus for packing granular material into a foundry receptacle having a cavity and a first opening leading into said cavity comprising:

a housing enclosing a chamber, said housing provided for being located above said first opening and having a second opening at the lower end of said housing in communication with said first opening; dispensing means for dispensing a granular material into said housing above said second opening;

air compressing means for compressing the air above said granular material for forcing a granular material through said first and second openings into said cavity;

said air compressing means is a piston means associated with said housing for compressing the air above said granular material to force the material into said cavity;

a baffle located in the lower end of said housing for substantially holding said granular material in said housing until the compressing means forces the granular material through said first and second openings into said cavity; and said baffle means comprising top surfaces inclined downwardly and outwardly and lower surfaces inclined downwardly and upwardly, said lower surfaces terminating at their lower ends at said second opening; said top surfaces and lower surfaces being vertically spaced from each other along the sides thereof to provide side openings whereby said granular material dispensed on said top surfaces when forced by compressed air flows over said top inclined surfaces outwardly to said side openings and then through said side openings inwardly over said lower surfaces to said second opening.

47. Apparatus for packing granular material into a foundry receptacle having a cavity and a first opening leading into said cavity comprising:

a housing enclosing a chamber, said housing provided for being located above said first opening and having a second opening at the lower end of said housing in communication with said first opening; dispensing means for dispensing a granular material into said housing above said second opening;

air compressing means for compressing the air above said granular material for forcing a granular material through said first and second openings into said cavity;

said air compressing means comprising a piston means associated with said housing for compressing the air above said granular material to force the sand core material into said cavity;

a baffle located in the lower end of said housing for substantially holding said granular material in said housing until the compressing means forces the material through said first and second openings into said cavity; and said baffle comprising a first baffle plate having lower surfaces inclined downwardly and inwardly from each side to said second opening forming a centrally located slot; a second baffle plate spacedly mounted above said first plate to provide said side openings; said second baffle plate having a top surface with portions inclined downwardly from a central section toward said side opening.

48. The apparatus of claim 47 in which the piston means includes a pressure packer means located for sliding movement in the chamber of said housing and an actuating cylinder piston operatively connected to said packer means for actuating said packer means; and a source of air pressure for actuating said piston.

* * * * *

UNITED STATES PATENT AND TRADEMARK OFFICE

CERTIFICATE OF CORRECTION

PATENT NO. : 5,535,809
DATED : July 16, 1996
INVENTOR(S) : Lyle E. White

It is certified that error appears in the above-indentified patent and that said Letters Patent is hereby corrected as shown below:

Column 4, line 39;
"frown" should be –from–.

Column 7, claim [29] 13, line 60;
"closed" should be –enclosed–.

Column 7, claim [30] 15, line 67;
"granular" should be –granulated–.

Column 8, claim [33] 17, lines 4 and 6;
Delete "means" after "baffle", 3 occurrences.

Column 8, claim [33] 17, line 10;
"granular" should be –granulated–

Column 8, claim [33] 17, line 11;
Change "receptacle means" to –mold–.

UNITED STATES PATENT AND TRADEMARK OFFICE

CERTIFICATE OF CORRECTION

PATENT NO. : 5,535,809
DATED : July 16, 1996
INVENTOR(S) : Lyle E. White

It is certified that error appears in the above-indentified patent and that said Letters Patent is hereby corrected as shown below:

Column 10, claim [35] 40, line 43;
"sand core" should be –granular–.

Column 10, claim [37] 42, line 51;
"grandular" should be –granular–.

Column 12, claim [39] 47, line 17;
"sand core" should be –granular–.

Signed and Sealed this

Twenty-first Day of January, 1997

*Attest:*

Bruce Lehman

BRUCE LEHMAN

*Attesting Officer*

*Commissioner of Patents and Trademarks*